US008545421B2

(12) United States Patent
Wu

(10) Patent No.: US 8,545,421 B2
(45) Date of Patent: Oct. 1, 2013

(54) MANUAL AND SPIRAL MASSAGE DEVICE

(76) Inventor: Dong-Her Wu, Chang Hua Hsien (TW)

( * ) Notice: Subject to any disclaimer, the term of this patent is extended or adjusted under 35 U.S.C. 154(b) by 399 days.

(21) Appl. No.: 12/898,865

(22) Filed: Oct. 6, 2010

(65) Prior Publication Data

US 2012/0053497 A1 Mar. 1, 2012

(30) Foreign Application Priority Data

Aug. 24, 2010 (TW) ..... 99216318 A

(51) Int. Cl.
*A61H 7/00* (2006.01)

(52) U.S. Cl.
USPC ..... 601/46; 601/97; 601/112

(58) Field of Classification Search
USPC ..... 601/46, 82–84, 97, 107, 108, 111, 601/112, 134, 135
See application file for complete search history.

(56) References Cited

U.S. PATENT DOCUMENTS 2,720,711 A * 10/1955 Gray et al. ..... 34/58
3,110,053 A * 11/1963 Surabian ..... 15/159.1
3,619,081 A * 11/1971 Gruska et al. ..... 416/70 R
4,167,054 A * 9/1979 Yamada et al. ..... 24/171
4,527,561 A * 7/1985 Burns ..... 606/182
5,154,685 A * 10/1992 Chen ..... 482/126
5,695,436 A * 12/1997 Huang ..... 482/121
5,749,815 A * 5/1998 Lipps ..... 482/122
7,294,113 B1 * 11/2007 Wu ..... 601/70
2002/0188236 A1 * 12/2002 Lin ..... 601/107
2010/0160841 A1 * 6/2010 Wu ..... 601/135

* cited by examiner

*Primary Examiner* — Justine Yu
*Assistant Examiner* — Katelyn Bernier
(74) *Attorney, Agent, or Firm* — Jackson IPG PLLC

(57) ABSTRACT

A manual and spiral massage device has a retractable rod unit, a bow-shaped frame, and a massage unit. The retractable rod unit has a T-shaped rod including a pair handles and a sleeve. The sleeve is connected with a first end of an inner pipe. A guide rod having a guide block is located in the sleeve. A second end of the inner pipe is inserted in an opening the bow-shaped frame. The massage unit includes an eccentric block, a massage block and the spiral rod. When the retractable rod unit is retracted inward or extended outward, the guide block will spirally turn the guide rod by the elastic force and the restore force of the resilient strips to turn the eccentric block clockwise and counterclockwise. The eccentric axle of the eccentric block drives the second bearing to turn the massage block clockwise and counterclockwise.

1 Claim, 11 Drawing Sheets

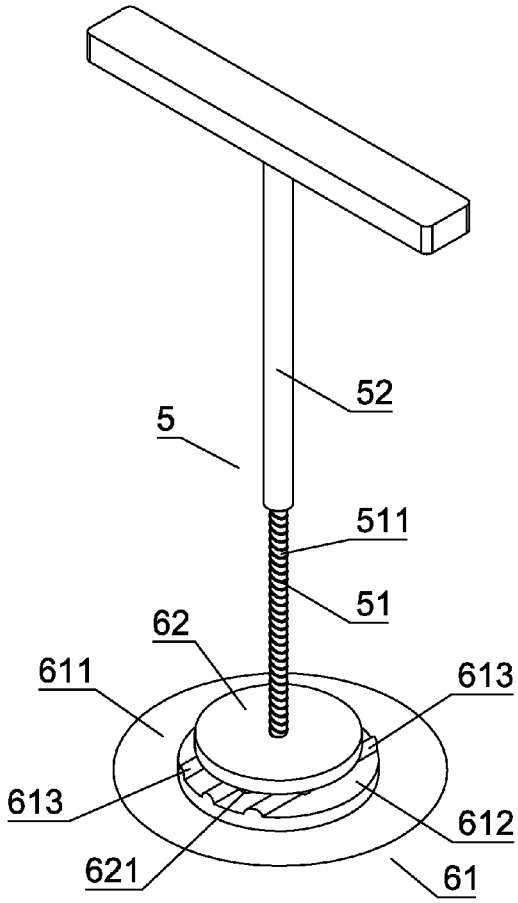
Fig. 1
Prior Art
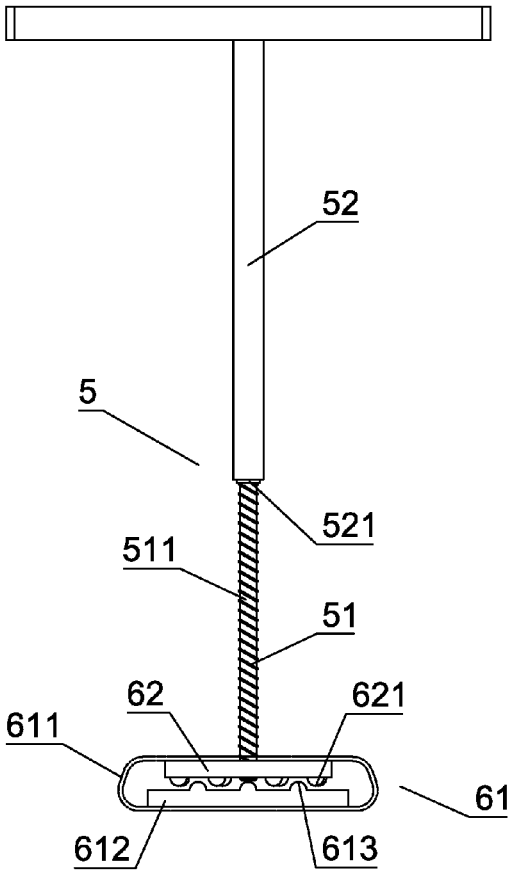
Fig. 1-A
Prior Art

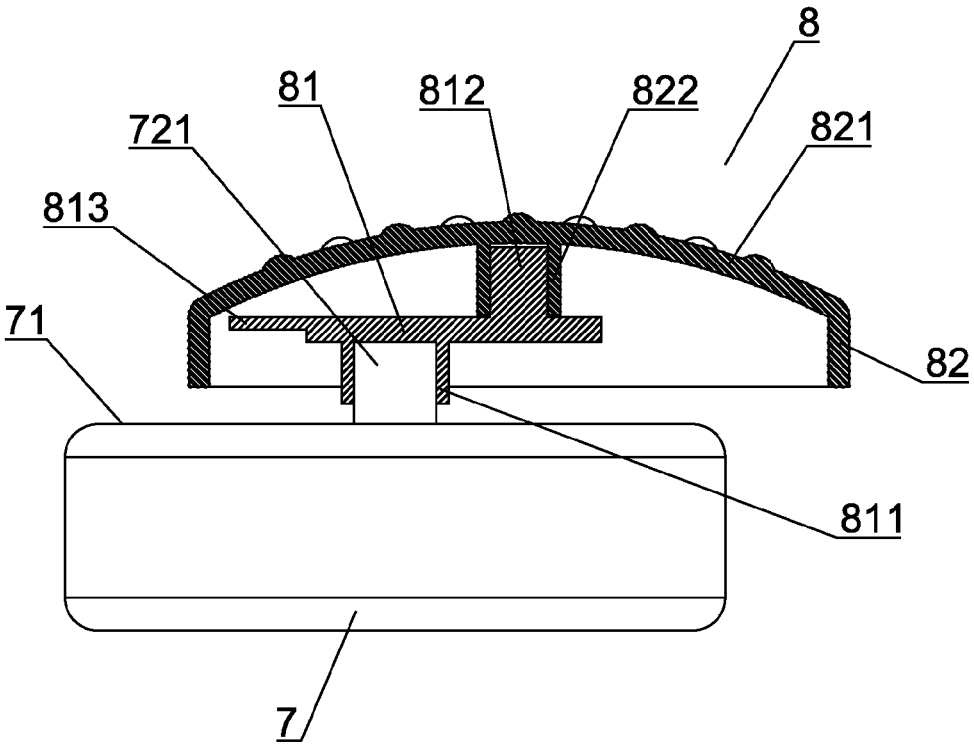
Fig. 2-A
Prior Art

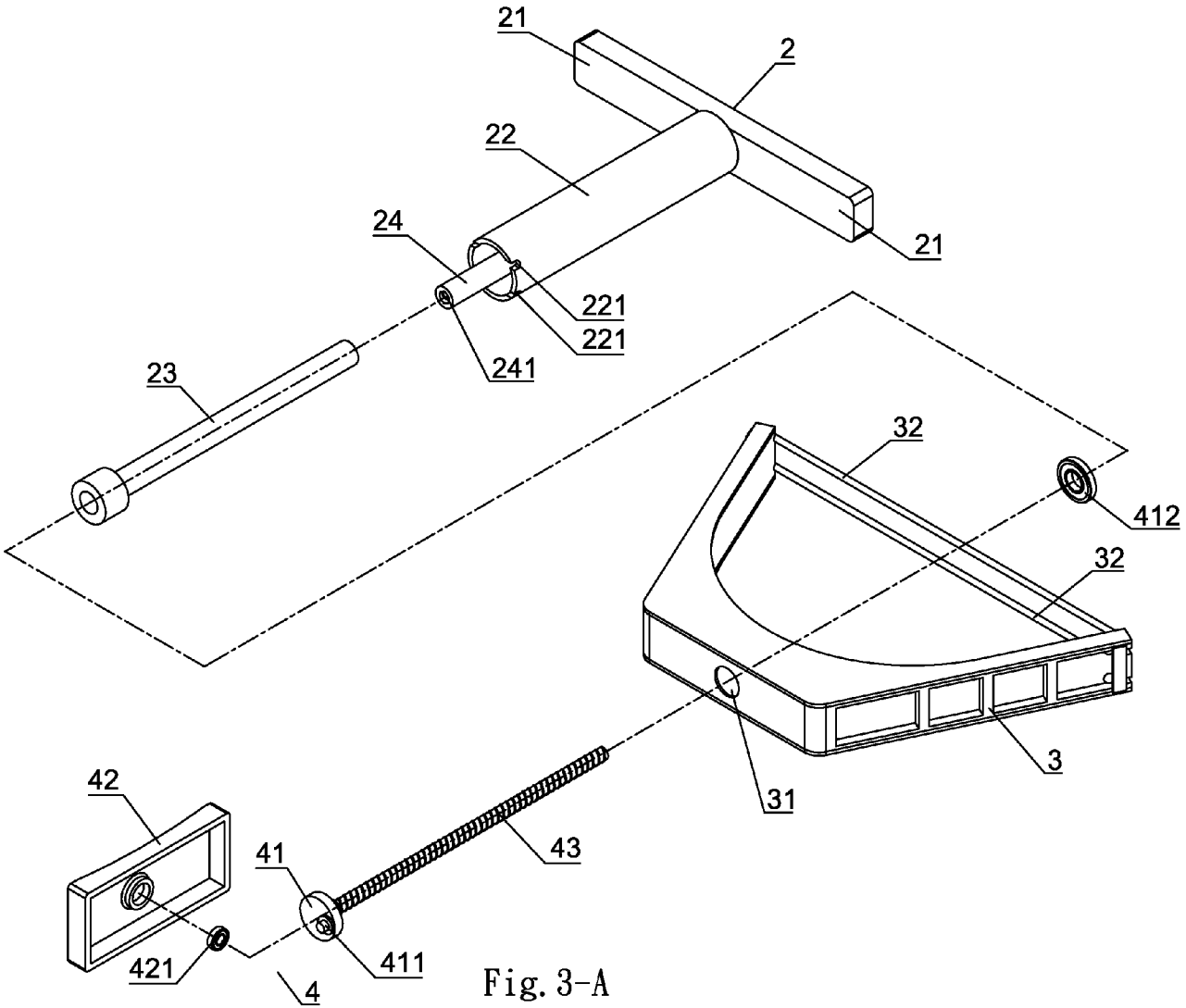
Fig. 3-A

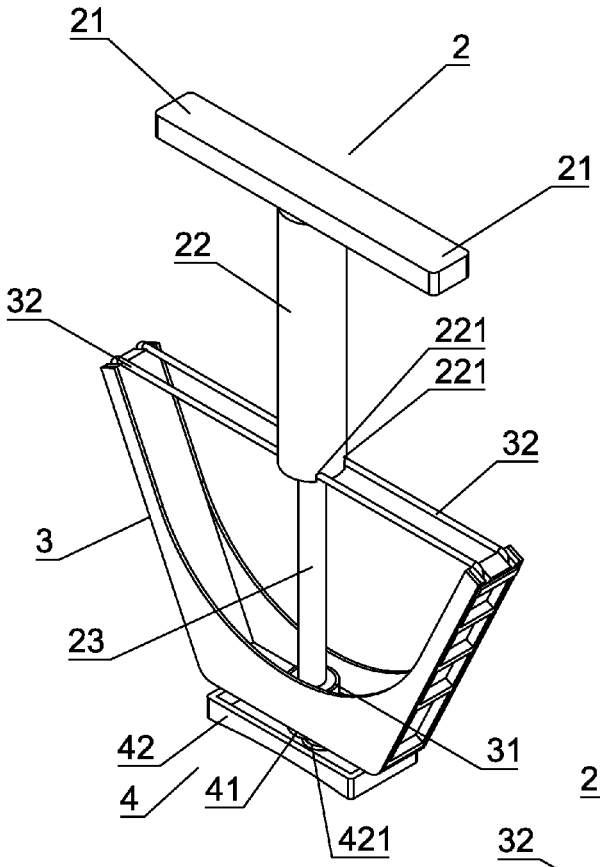
Fig. 4-A
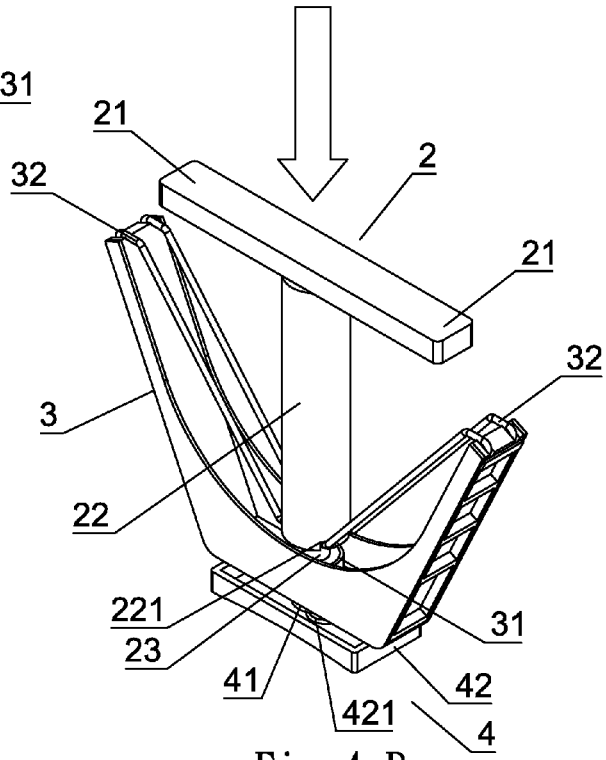
Fig. 4-B

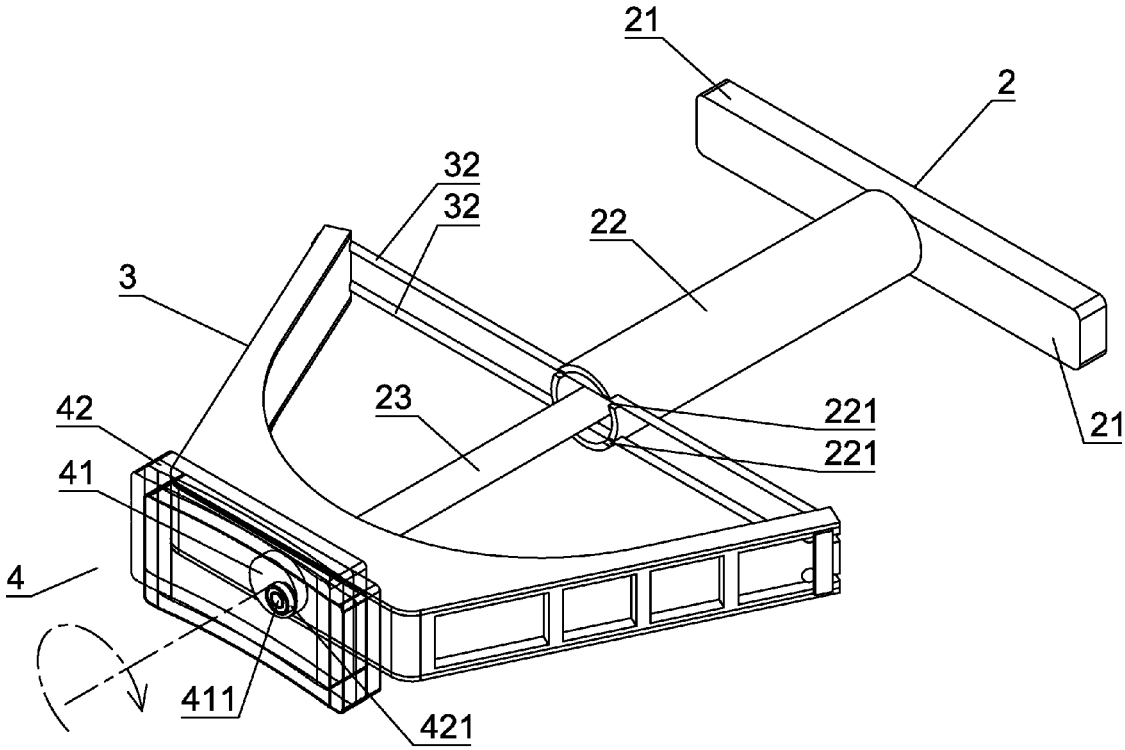
Fig. 5
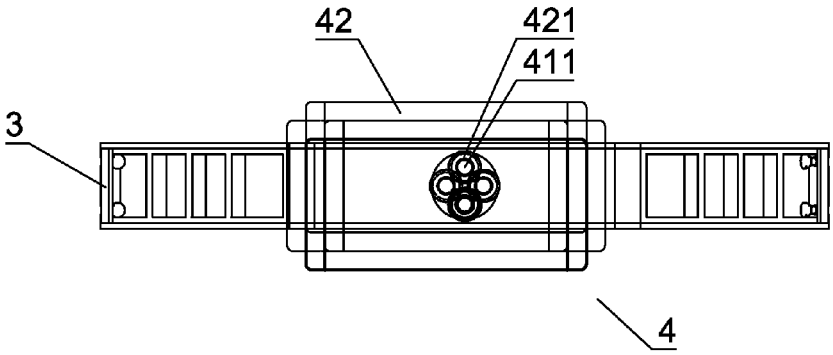
Fig. 5-A

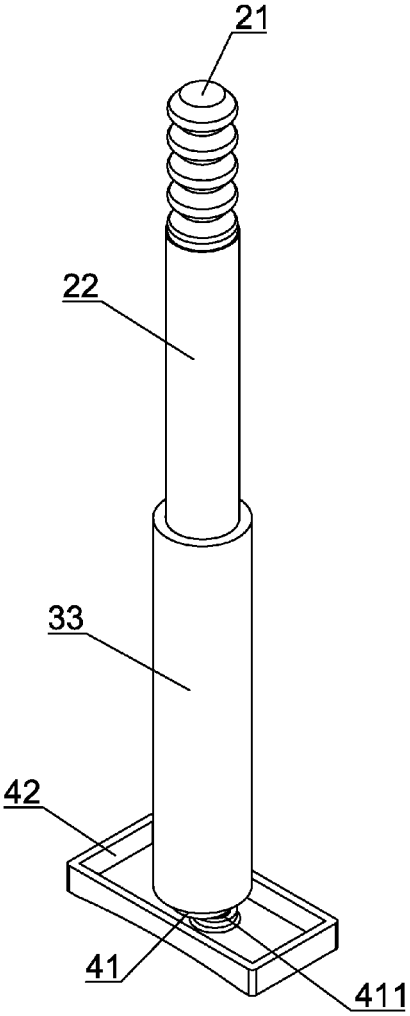
Fig. 6
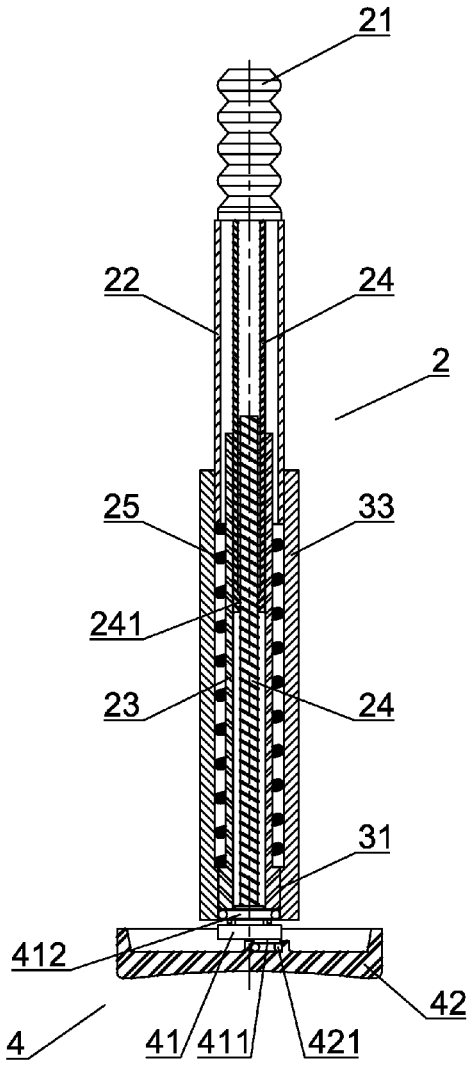
Fig. 6-A

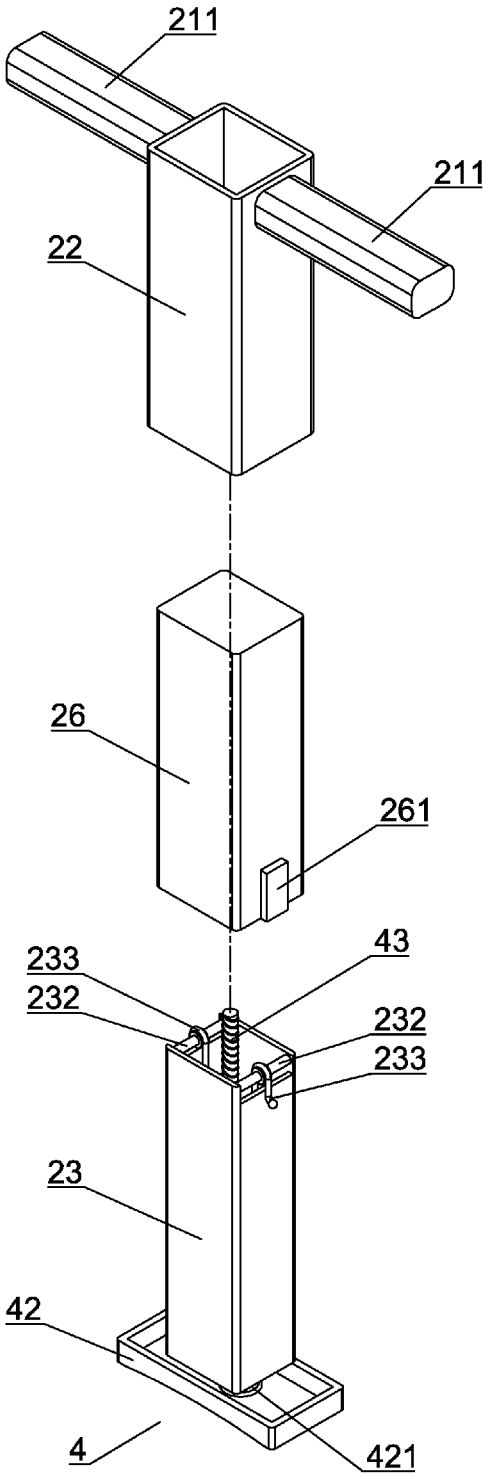
Fig. 7
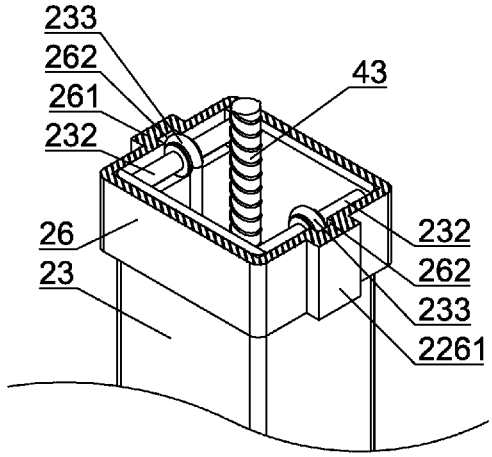
Fig. 7-A
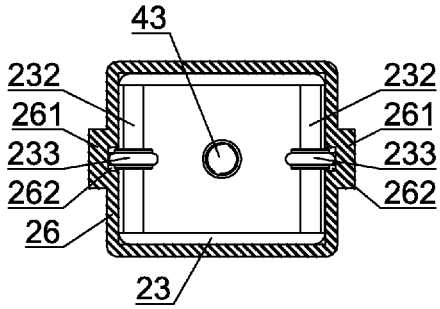
Fig. 7-B

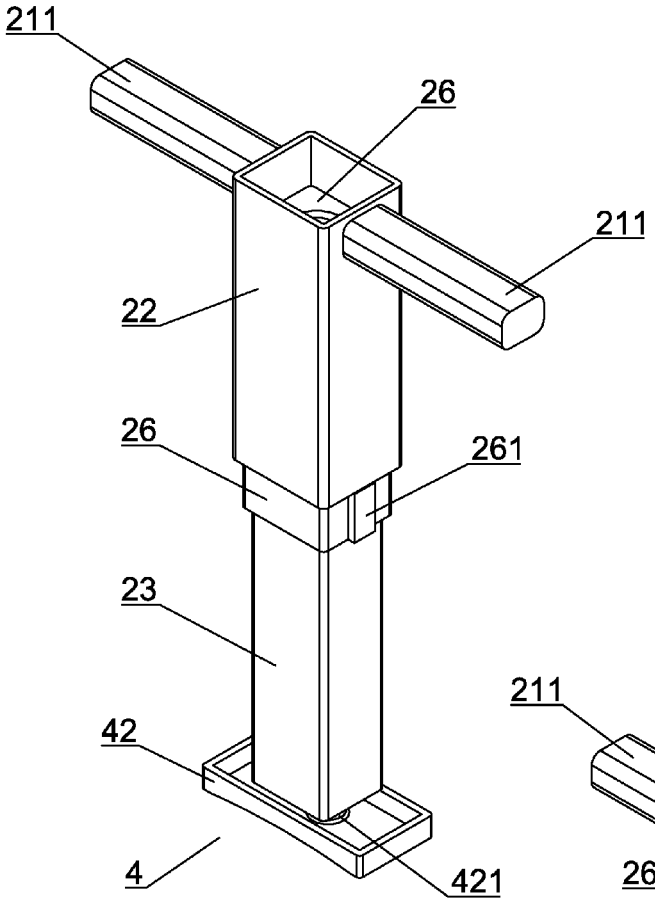
Fig. 8-A
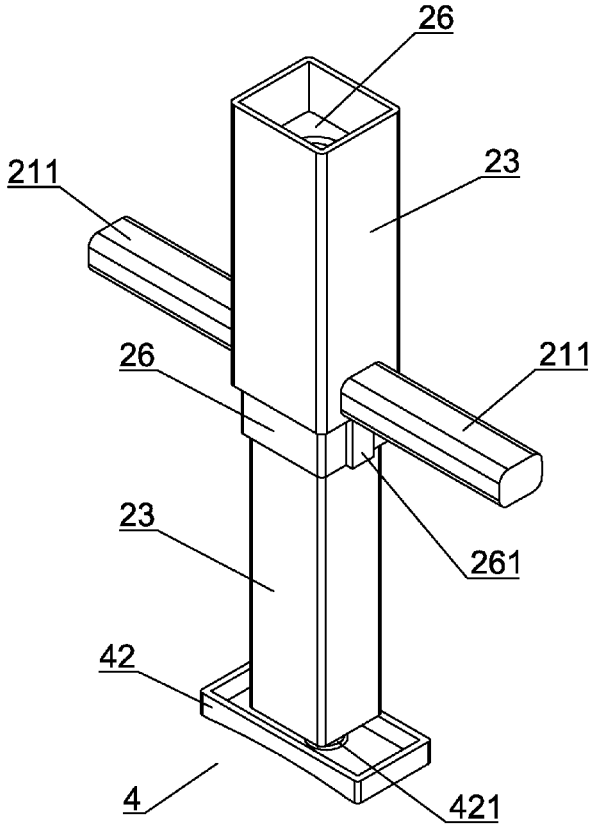
Fig. 8-B

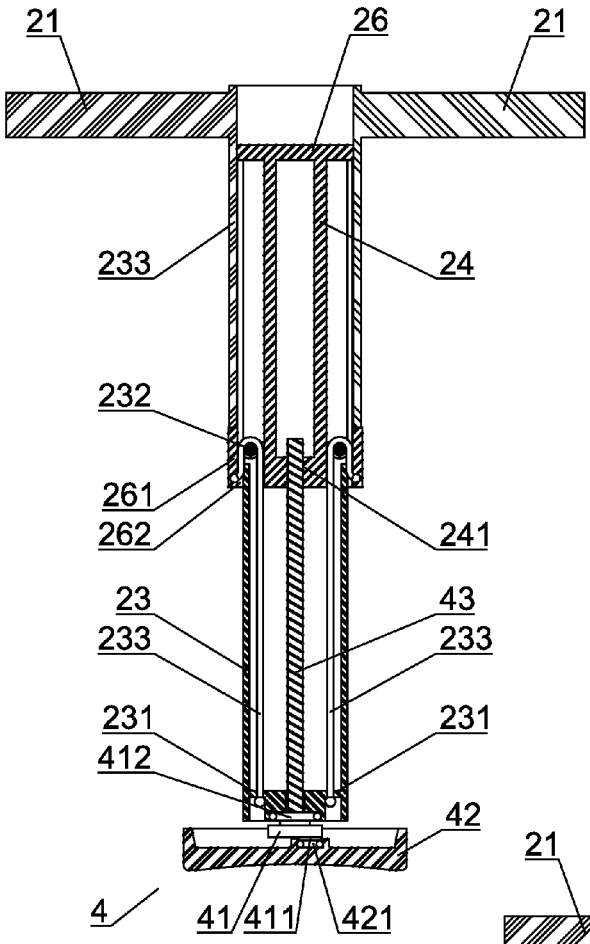
Fig. 9-A
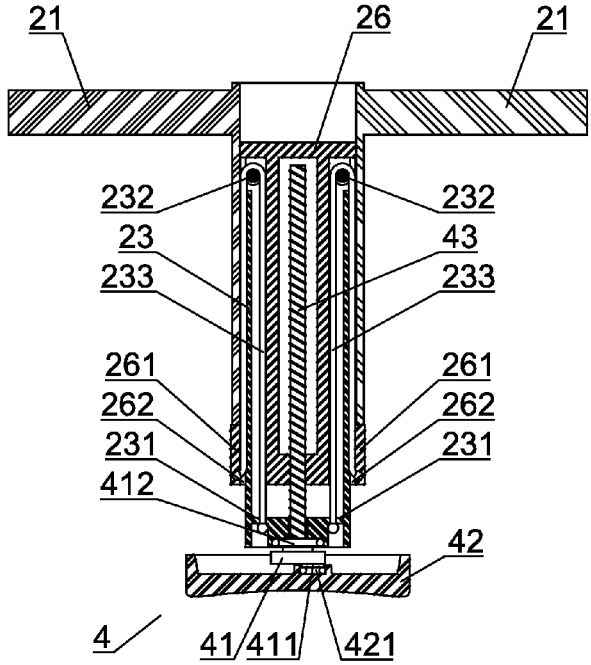
Fig. 9-B

MANUAL AND SPIRAL MASSAGE DEVICE

BACKGROUND OF THE INVENTION

1. Field of the Invention

The present invention relates to a manual and spiral massage device, and more particularly to one having a retractable rod unit and a massage unit. The retractable unit is moved inward and outward to drive a massage block of the massage unit to turn clockwise and counterclockwise so as to massage the user's arm, neck, chest, waist, abdomen, and so on.

2. Description of the Prior Art

The difference between an abdomen exerciser and a power-driven device which is used to massage abdomen or a manual massage device is that the abdomen exerciser is transversely placed in front of the user's abdomen and pushed toward the abdomen by the user's hand. The abdomen exerciser will be pushed outward after the abdomen bears the pressure so as to exercise the user's upper body.

The pad of the conventional abdomen exerciser is contact with the body and the abdomen in a fixed way. When in use, the abdomen exerciser applies a force to the muscles of the abdomen frontward and rearward in a horizontal direction. This operation can exercise the user's upper body, but it cannot massage the fat of the user's abdomen.

Therefore, an improved abdomen exerciser to provide an abdomen pad which can massage and vibrate the abdomen is development. As shown in FIG. 1, FIG. 1-A, the abdomen exerciser comprises a retractable portion 5 at the middle of the abdomen exerciser and an abdomen pad 6. The retractable portion 5 includes a retractable rod 51 and a sleeve 52. The retractable rod 51 has threads 511 thereon. The lower end of the sleeve 52 is provided with block 521 corresponding to the threads 511, so that the block 521 is moved along the threads 511. The abdomen pad 6 includes an outer pad 61 and an inner pad 62 with is wrapped by the outer pad 61. The top of the inner pad 62 is coupled to the bottom of the retractable rod 51 to be linked by the retractable rod 51. The bottom of the inner pad 62 is provided with a plurality of protrusions 621. The outer pad 61 includes a pad block 612 and a wrapping surface 611. The pad block 612 has a plurality of ribs 613 thereon. The wrapping surface 611 is used to wrap the inner pad 62 and the pad block 612. The pad block 612 is located under the inner pad 62. The retractable rod 51 is rotated to vibrate the abdomen pad 6 so as to massage the user's abdomen.

As shown in FIG. 2, FIG. 2-A, a power-driven massage device comprises a housing 7, a motor 71 in the housing 7, and a lid 72 in conjunction with the housing 7 to cover the motor 72. The motor 72 has an axle 721 to connect with a massage unit 8. The massage unit 8 comprises a rotary member 81 and a massage member 82. The rotary member 81 includes an eccentric fixing portion 811, a protruding axle 812, and a balance weight portion 813. The massage member 82 has a massage surface 821 and a pivot portion 822 which extends inward from the massage surface 821. The protruding axle 812 is pivotally connected to the pivot portion 822. The protruding axle 812 is rotatable relative to the pivot portion 822. The massage member 82 is eccentricly rotated, with the massage surface 821 to get contact with the user's body. The counterforce will be counterbalanced through the protruding axle 812 and the pivot portion 822. At this time, the massage member 82 is rotated slowly. The torsional force outputted from the axle 721 of the motor 72 in conjunction with the balance weight portion 813 of the massage member 81 generates a massage motion. With the pivot portion 822 and the protruding axle 812 as a rotation center, the massage surface 821 is used to massage the user.

However, the former abdomen exerciser is operated in a horizontal direction to provide a slight vibration. The effect to massage the fat of the abdomen is limited. The vibration of the abdomen pad and the user's applying force are in the same direction, which results in that it is not easy to turn the abdomen pad 6. The expected effect to massage the abdomen cannot be achieved. The latter power-driven massage device only massages the contact portion.

Therefore, the present invention is to provide a manual and spiral massage device, which can be reciprocated to massage the abdomen.

SUMMARY OF THE INVENTION

According to a first aspect of the present invention, there is provided a manual and spiral massage device which comprises a retractable rod unit, a bow-shaped frame, and a massage unit. The retractable rod unit comprises a T-shaped rod composed of a pair handles and a sleeve. A first end of the sleeve is connected to the pair of handles, and a second end of the sleeve is connected with a first end of an inner pipe. The second end of the sleeve is formed with two grooves to receive two resilient strips of the bow-shaped frame. A guide rod having a guide block is provided in the sleeve. The guide rod is reciprocated in the inner pipe. The guide block is screwed to a spiral rod of the massage unit. A second end of the inner pipe is inserted in an opening the bow-shaped frame. The massage unit comprises an eccentric block, a massage block and the spiral rod. A first end of the spiral rod is connected with the guide block of the guide rod, and a second end of the spiral rod is connected with an eccentric axle of the eccentric block. The first bearing is fitted on the spiral rod and coupled at the opening of the bow-shaped frame. A second bearing is pivotally connected between the eccentric axle and a central portion of the massage block. When applying a force inward, the retractable rod unit will be moved inward and pushed reversely by the elastic force of the resilient strips. The guide block is moved to the eccentric block along the spiral rod to turn the eccentric axle. The eccentric axle brings the second bearing to eccentricly turn the massage block, so the massage block can massage the desired portion of the user. When be released, the retractable rod unit is pushed back by the restore force of the resilient strips. The guide block is turned reversely along the spiral rod. The eccentric axle of the eccentric block is also turned reversely. The eccentric axle drives the second bearing to turn the massage block reversely, so the massage block can massage the desired portion reversely. The present invention provides an eccentric motion without resistance to turn clockwise and counterclockwise.

According to a second aspect of the present invention, there is provided a manual and spiral massage device which comprises a retractable rod unit and a massage unit. A spring is fitted on the inner pipe. The spring has two ends against the second end of the sleeve and an opening, respectively. A protection sleeve is fitted on the spring and connected to the sleeve, functioning as the resilient strips of the bow-shaped frame for providing the elastic force and restore force to the retractable rod unit when being pulled and released.

According to a third aspect of the present invention, there is provided a manual and spiral massage device which comprises a retractable rod unit and a massage unit. The retractable rod unit comprises a T-shaped rod composed of a pair handles and a hollow sleeve. The hollow sleeve is fitted on a retractable sleeve. The retractable sleeve is fitted on the inner pipe, and has two inner engaging grooves and two outer engaging blocks at two sides thereof. The first end of the guide rod is connected to the top of the sleeve. A lower end of the inner pipe is connected with a fixing plate, and an upper end of the inner pipe is pivotally connected with two fixed pulleys at two sides thereof. Two resilient strips have two ends connected to the fixing plate and the bottom of the retractable sleeve, respectively. The two resilient strips pass the fixed pulleys and reciprocate in the engaging grooves, functioning as the two resilient strips of the bow-shaped frame for providing the elastic force and restore force to the retractable rod unit when being pulled and released and having the same effect as the aforesaid embodiments.

BRIEF DESCRIPTION OF THE DRAWINGS

FIG. 1 is a perspective view of a conventional abdomen exerciser;

FIG. 1-A is a front view of the conventional abdomen exerciser;

FIG. 2-A is a cross-sectional view of the conventional power-driven massage machine;

FIG. 3-A is an exploded view according to the first embodiment of the present invention;

FIG. 4-A is a perspective view according to the first embodiment of the present invention;

FIG. 4-B is a schematic view showing the operation of the retractable rod unit according to the first embodiment of the present invention;

FIG. 5 is a schematic view showing the operation of the massage block according to the first embodiment of the present invention;

FIG. 5-A is a front view of the massage block according to the first embodiment of the present invention;

FIG. 6 is a perspective view according to a second embodiment of the present invention;

FIG. 6-A is a cross-sectional view according to the second embodiment of the present invention;

FIG. 7 is an exploded view according to a third embodiment of the present invention;

FIG. 7-A is a partially perspective view showing the resilient strips on the fixed pulleys according to the third embodiment of the present invention;

FIG. 7-B is a top view showing the resilient strips on the fixed pulleys according to the third embodiment of the present invention;

FIG. 8-A is a perspective view according to the third embodiment of the present invention;

FIG. 8-B is another perspective view according to the third embodiment of the present invention;

FIG. 9-A is a cross-sectional view according to the third embodiment of the present invention; and FIG. 9-B is another cross-sectional view in an operated status according to the third embodiment of the present invention; and

DETAILED DESCRIPTION OF THE PREFERRED EMBODIMENTS

Embodiments of the present invention will now be described, by way of example only, with reference to the accompanying drawings.

Figure 2:
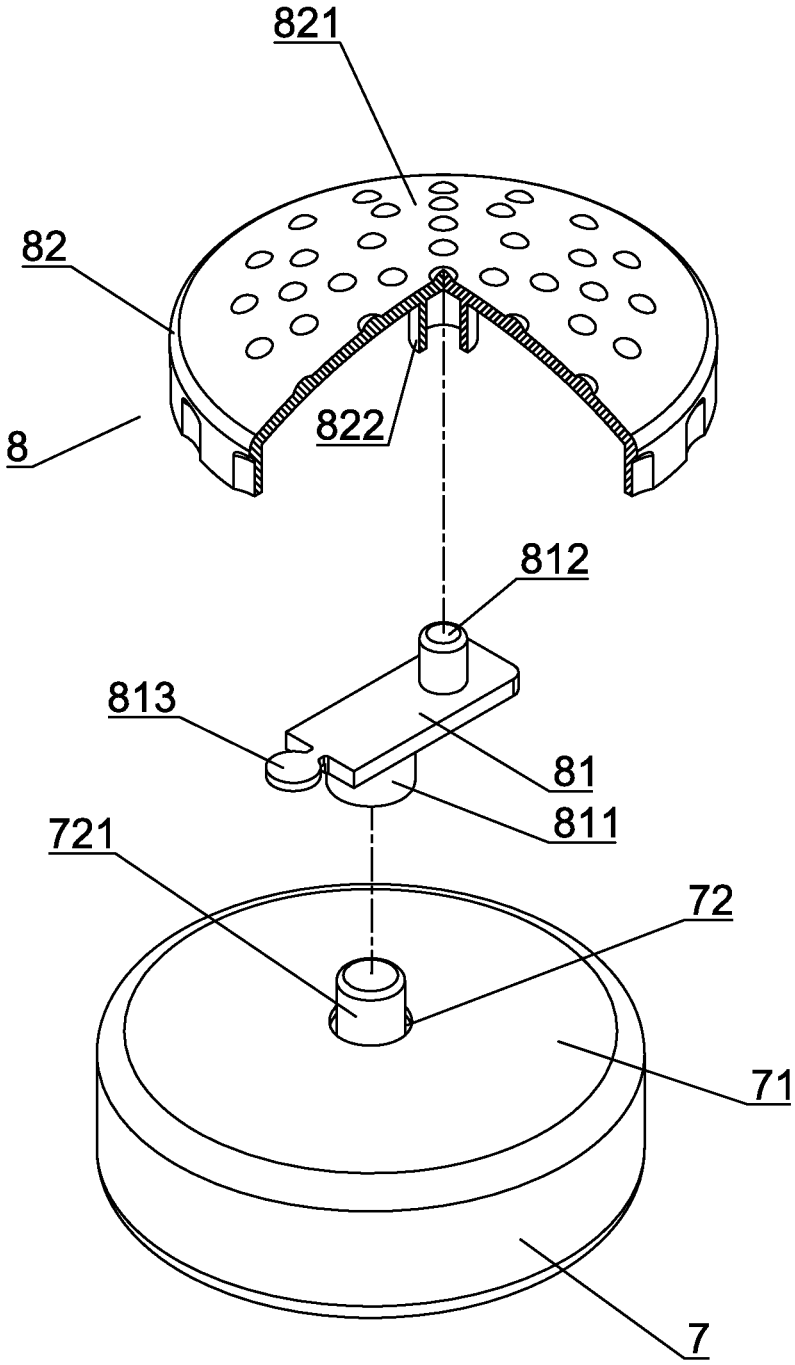
Fig. 2 Prior Art
FIG. 2 is an exploded view of a conventional power-driven massage machine.
Figure 3:
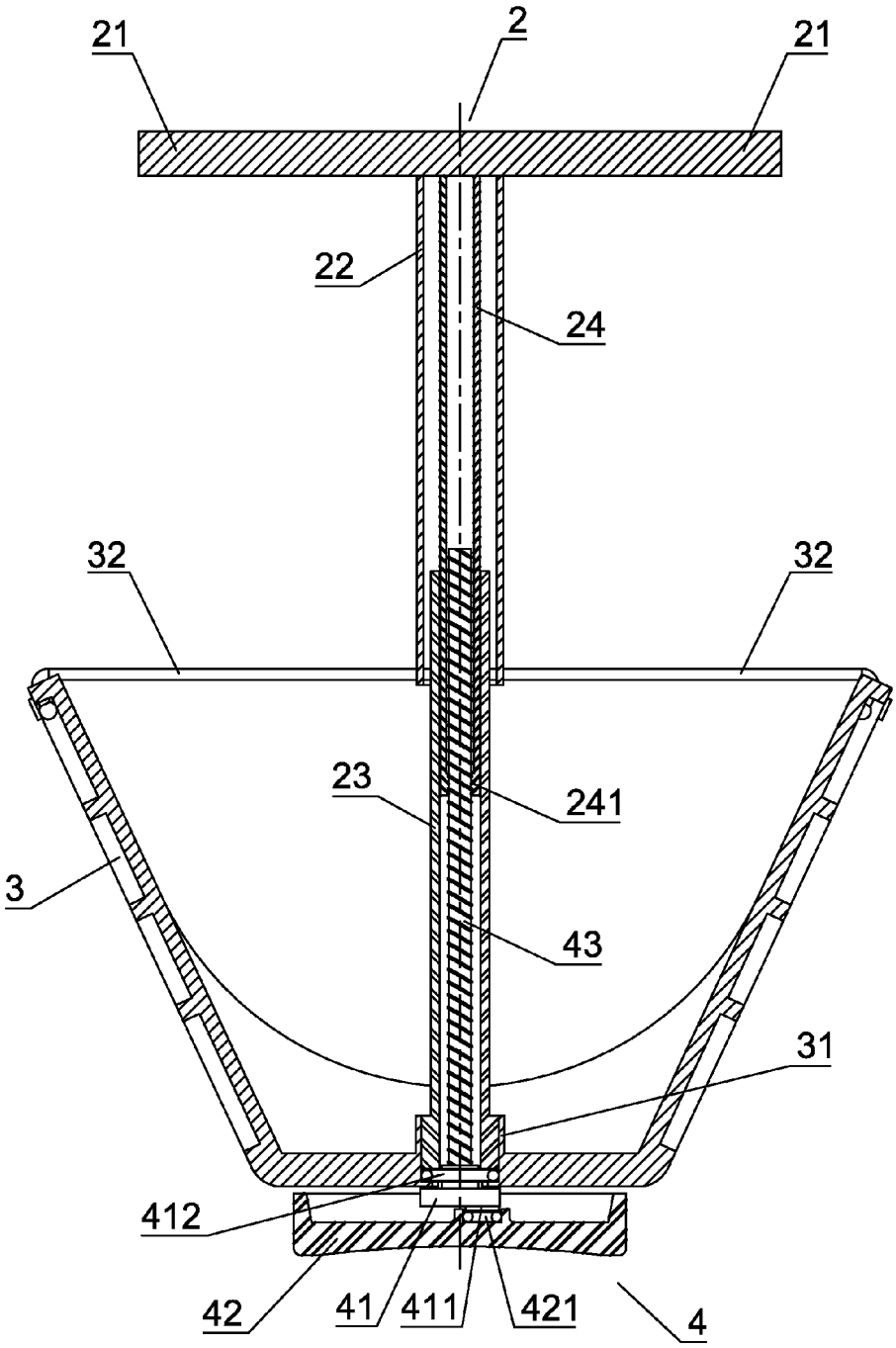
FIG. 3 is a cross-sectional view according to a first embodiment of the present invention.

As shown in FIG. 3, FIG. 3-A, FIG. 4-A, FIG. 4-B, FIG. 5 and FIG. 5-A, a manual and spiral massage device according to a first embodiment of the present invention comprises a retractable rod unit 2, a bow-shaped frame 3, and a massage unit 4.

The retractable rod unit 2 comprises a T-shaped rod composed of a pair handles 21 and a sleeve 22. The handles 21 are adapted for the user to grasp thereon. A first end of the sleeve 22 is connected to the pair of handles 21, and a second end of the sleeve 22 is connected with a first end of an inner pipe 23. The second end of the sleeve 22 is formed with two grooves 221 to receive two resilient strips 32 of the bow-shaped frame 3. A guide rod 24 having a guide block 241 is provided in the sleeve 22. The guide rod 24 is reciprocated in the inner pipe 23. The guide block 241 is screwed to a spiral rod 43 of the massage unit 4. A second end of the inner pipe 23 is inserted in an opening 31 the bow-shaped frame 3.

The bow-shaped frame 3 has the opening 31 formed at a central portion of the bottom of the bow-shaped frame for connection of the inner pipe 23 of the retractable rod unit 2 and a first bearing 412 of the massage unit 4. The two resilient strips 32 are connected to two ends of the bow-shaped frame 3 and provide resilient force and restore force to the retractable rod unit 2 when being pulled or released.

The massage unit 4 comprises an eccentric block 41, a massage block 42 and the spiral rod 43. A first end of the spiral rod 43 is connected with the guide block 241 of the guide rod 24, and a second end of the spiral rod 43 is connected with an eccentric axle 41 of the eccentric block 41. The first bearing 412 is fitted on the spiral rod 43 and coupled at the opening 31 of the bow-shaped frame 3 to stable the rotation of the spiral rod 43. A second bearing 421 is pivotally connected between the eccentric axle 411 and a central portion of the massage block 42. The massage device of the present invention can massage the user's arm, neck, chest, waist, abdomen, and so on.

As shown in FIG. 3, FIG. 3-A, FIG. 4-A, FIG. 4-B, FIG. 5 and FIG. 5-A, the inner pipe 23 of the retractable rod unit 2 is inserted in the opening 31 of the bow-shaped frame 3. The grooves 221 of the sleeve 22 engage with the resilient strips 32. The guide rod 24 is inserted in the inner pipe 23. The guide block 241 is connected to the first end of the spiral rod 43 of the massage unit 4. The massage block 41 is against the user's abdomen. The user grasps the handles 21 with his/her hand. When applying a force inward, the retractable rod unit 2 will be moved inward and pushed reversely by the elastic force of the resilient strips 32. The guide block 24 is moved to the eccentric block 41 along the spiral rod 43 to turn the eccentric axle 411. The eccentric axle 411 brings the second bearing 421 to eccentricly turn the massage block 42, so the massage block 42 can massage the desired portion of the user. When be released, the retractable rod unit 2 is pushed back by the restore force of the resilient strips 32. The guide block 241 is turned reversely along the spiral rod 43. The eccentric axle 411 of the eccentric block 41 is also turned reversely. The eccentric axle 411 drives the second bearing 421 to turn the massage block 42 reversely, so the massage block 42 can massage the desired portion reversely. The present invention provides an eccentric motion without resistance to turn clockwise and counterclockwise.

FIG. 6 and FIG. 6-A show a second embodiment of the present invention. The handle 21 of the retractable rod unit 2 is disposed at the first end of the sleeve 22 for the user to grasp there on. A spring 25 is fitted on the inner pipe 23. The spring 25 has two ends against the second end of the sleeve 22 and an opening 31, respectively. A protection sleeve 33 is fitted on the spring 25 and connected to the sleeve 22, functioning as the resilient strips 32 of the bow-shaped frame 3 for providing the elastic force and restore force to the retractable rod unit 2 when being pulled and released.

FIG. 7, FIG. 7-A, FIG. 7-B, FIG. 8-A, FIG. 8-B, FIG. 9-A and FIG. 9-B show a third embodiment of the present invention. The retractable rod unit 2 comprises a T-shaped rod composed of a pair handles 211 and a hollow sleeve 22. The handles 211 are adapted for the user to grasp thereon. The hollow sleeve 22 is fitted on a retractable sleeve 26. The retractable sleeve 26 is fitted on the inner pipe 23, and has two inner engaging grooves 262 and two outer engaging blocks 261 at two sides thereof. The engaging blocks 2261 are adapted to hold against a bottom edge of the sleeve 22. The first end of the guide rod 24 is connected to the top of the sleeve 22. A lower end of the inner pipe 23 is connected with a fixing plate 231, and an upper end of the inner pipe 23 is pivotally connected with two fixed pulleys 232 at two sides thereof. Two resilient strips 233 have two ends connected to the fixing plate 231 and the bottom of the retractable sleeve 226, respectively. The two resilient strips 233 pass the fixed pulleys 232 and reciprocate in the engaging grooves 262, functioning as the two resilient strips 32 of the bow-shaped frame 3 for providing the elastic force and restore force to the retractable rod unit 2 when being pulled and released. The T-shaped sleeve 22 can be reversely fitted on the retractable sleeve 26 to shorten the distance, having the same effect as the aforesaid embodiments.

Accordingly, the present invention can massage the user's arm, neck, chest, waist, abdomen and son on, and can be operated clockwise or counterclockwise.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A manual and spiral massage device, comprising a retractable rod unit, a bow-shaped frame and a massage unit, the retractable rod unit comprising a T-shaped rod composed of a pair handles and a sleeve, a first end of the sleeve being connected to the pair of handles, a second end of the sleeve being connected with a first end of an inner pipe, the second end of the sleeve being formed with two grooves to receive two resilient strips of the bow-shaped frame, a guide rod having a guide block being pivotally connected in the sleeve, the guide block being screwed to a spiral rod of the massage unit, a second end of the inner pipe being inserted in an opening of the bow-shaped frame, the massage unit comprising an eccentric block, a massage block and the spiral rod, a first end of the spiral rod being connected with the guide block of the guide rod, a second end of the spiral rod being connected with an eccentric axle of the eccentric block, a first bearing being fitted on the spiral rod and coupled at the opening of the bow-shaped frame, a second bearing being pivotally connected between the eccentric axle and a central portion of the massage block, thereby, when the retractable rod unit is retracted inward or extended outward, the guide block spirally turns the guide rod by an elastic force and a restore force of the resilient strips to turn the eccentric block clockwise and counterclockwise, the eccentric axle of the eccentric block driving the second bearing to turn the massage block clockwise and counterclockwise.

* * * * *